US010407277B2

(12) United States Patent
Koch et al.

(10) Patent No.: US 10,407,277 B2
(45) Date of Patent: Sep. 10, 2019

(54) INTEGRATED CATCHING DEVICE ON OVERTRAVEL BRAKE DEVICES

(71) Applicant: SIEMAG TECBERG GmbH, Haiger (DE)

(72) Inventors: Matthias Koch, Breitscheid (DE); Johann Merkel, Netphen (DE)

(73) Assignee: SIEMAG TECBERG GmbH, Haiger (DE)

( * ) Notice: Subject to any disclaimer, the term of this patent is extended or adjusted under 35 U.S.C. 154(b) by 574 days.

(21) Appl. No.: 14/763,321

(22) PCT Filed: Nov. 22, 2013

(86) PCT No.: PCT/EP2013/074485

§ 371 (c)(1),
(2) Date: Jul. 24, 2015

(87) PCT Pub. No.: WO2014/114384

PCT Pub. Date: Jul. 31, 2014

(65) Prior Publication Data

US 2015/0360907 A1 Dec. 17, 2015

(30) Foreign Application Priority Data

Jan. 28, 2013 (DE) ..... 10 2013 001 405

(51) Int. Cl.
*B66B 5/08* (2006.01)
*B66B 5/26* (2006.01)

(52) U.S. Cl.
CPC . *B66B 5/08* (2013.01); *B66B 5/26* (2013.01)

(58) Field of Classification Search
CPC ..... B66B 5/08; B66B 5/26
See application file for complete search history.

(56) References Cited

U.S. PATENT DOCUMENTS 818,523 A * 4/1906 Dahlin ..... B66B 5/08 187/349
889,408 A * 6/1908 Shewan ..... B66B 5/08 187/349
944,942 A * 12/1909 Burns ..... B66B 5/08 187/349
1,042,172 A * 10/1912 Tessmer ..... B66B 5/08 187/349
1,334,116 A 3/1920 Peskolich
1,368,103 A * 2/1921 Boggio ..... B66B 5/08 187/349
1,533,576 A * 4/1925 Forsyth ..... B66B 5/22 187/349

(Continued)

FOREIGN PATENT DOCUMENTS

CN 2360375 U 1/2000
CN 101891093 A 11/2010

(Continued)

*Primary Examiner* — Michael A Riegelman
(74) *Attorney, Agent, or Firm* — 24IP Law Group USA, PLLC; Timothy Dewitt

(57) ABSTRACT

An apparatus for catching a shaft conveyor means (5) in the event of overtravel of a conveyor device, including an overtravel brake device, wherein coupling devices (80,90) are provided for automatic, form-fitting engagement with one another for fixing on the brake device and on the shaft conveyor means (50).

10 Claims, 4 Drawing Sheets

(56) References Cited

U.S. PATENT DOCUMENTS

| | | | | | |
|---|---|---|---|---|---|
| 1,633,836 | A * | 6/1927 | Wustenhofer | B66B 5/26 | 187/362 |
| 1,820,427 | A * | 8/1931 | Birmann | B66B 5/26 | 187/349 |
| 2,403,333 | A * | 7/1946 | Bjerke | B66B 5/26 | 187/363 |
| 5,209,325 | A * | 5/1993 | Gines | B60T 7/126 | 187/375 |
| 6,131,703 | A * | 10/2000 | Gates | B66B 5/12 | 187/351 |
| 2015/0101891 | A1* | 4/2015 | Abu Al-Rubb | B66B 5/26 | 187/359 |

FOREIGN PATENT DOCUMENTS

| | | | |
|---|---|---|---|
| CN | 204490295 | | 7/2015 |
| DE | 130 983 | C | 3/1902 |
| DE | 100 45 490 | A1 | 2/2002 |
| GB | 090 25 | A | 8/1911 |
| GB | 912 746 | A | 12/1962 |
| GB | 202 5363 | A | 1/1980 |
| SU | 623 804 | A1 | 9/1978 |

* cited by examiner

INTEGRATED CATCHING DEVICE ON OVERTRAVEL BRAKE DEVICES

BACKGROUND OF THE INVENTION

Field of the Invention

The present invention relates to a catching device on overtravel brake devices, as described by the preamble of the independent patent claim.

Brief Description of the Related Art

In shaft hoisting in the mining industry a known problem is the overtravelling of hoisting means. The term overtravelling therein describes the situation that in shaft hoisting the hoisting cage comes to a standstill only above the pithead or the nominal loading/unloading position, i.e. the apparatus and installations in the mine building above ground. There is a risk that the cages are pulled up to the upper end of the pithead frame as a result of a failure due to their greater speed and the moving masses of the hoisting system.

In shaft hoisting technology therefore, for the case of overtravelling of a hoisting means and a possible rope breakage in the course of this, currently catch pawls are used in the area of the clear height for protecting the hoisting means from crashing, which pawls are attached independently of the hoisting means and independently of a braking device (e.g. SSA as offered by the company Siemag Tecberg). The catch pawls are as a rule mounted in the guide frame.

The catch pawls are configured such that these are opened by the hoisting means during passage of the hoisting means through the catch pawls and are subsequently close again independently, usually by force of weight. The opening is made possible/realized for example by pivotally mounting the catch pawls outside of their balance point. The closing of the catch pawls can be effected e.g. by actuation or by the own weight of the catch pawls.

In the closed state, the catch pawls rest against a firm stop, such that a hoisting means dropping down from above can be caught.

In order to illustrate the catching process, the following scenario is described:

The hoisting system overtravels and the hoisting machine is neither turned off nor braked.

The hoisting means hits an overtravel and braking device at full or partial nominal speed.

The braking device brakes the hoisting means.

The hoisting means moves up to the area of the catch pawls, with the catch pawls being opened in the process.

After the hoisting means has passed the catch pawls, these are closed or fall shut due to their own weight.

The rope tears (machine has not been turned off), e.g. after collision with the final and static bumpers at the end of the overtravel path.

After the braking process has been concluded, the hoisting means drops down in the direction of the shaft depth.

The hoisting means strikes the catch pawls.

It should be remarked that numerous further scenarios are possible.

The current catching apparatus have a number of disadvantages and problems, however.

The effect of the catching apparatus is location-dependent. This means that the catch pawls are attached outside of the system consisting of hoisting means/security-braking device (SSA). Consequently the free fall of the hoisting means must necessarily take place before the hoisting means is caught in the catch pawls. The free fall causes a collision of the hoisting means with the catch pawls, the impact being uncontrolled in the worst case. This has the disadvantageous consequence that persons or goods located in the hoisting cage are subjected to an abrupt thrusting movement, which can lead to physical injury and/or damage of the goods. Further, the catch pawls and/or the head frame of the hoisting means could be deformed to an impermissible degree upon impact, which can lead to disastrous results in turn.

Since the effect of the catch pawls is location-dependent, it can occur that, in the case of an unfavorable scenario and when the arrangement of the catch pawls is inexpedient, the rope breaks before the hoisting means has passed the catch pawls. In this case the hoisting means would crash down the depth of the shaft completely uncontrollably.

A different, dangerous scenario would be that after braking the system upon overtravelling, the catch pawls are not reached and the braking system of the hoisting machine is ineffective; also in this case, the hoisting means would move down the shaft in uncontrolled fashion due to the gravitational forces.

When the catch pawls are arranged far down in the area of the clear height, e.g. to ensure a sufficient safety distance from the height where the hoisting means comes to a standstill, to the height where already closed catch pawls rest, there is a risk in the case of the scenario where the free fall is disproportionately high that the impact will consequently cause substantial damage to persons and/or goods.

Moreover, for the known solutions special fastening structures are required for the catch pawls, thereby causing additional costs.

SUMMARY OF THE INVENTION

It is consequently the object of the present invention to increase the functionality and the safety of the catching apparatus for hoisting means after overtravelling, and to reduce the costs for this assembly, wherein the effect of the catching apparatus is to materialize immediately after the hoisting device has hit the brake frame of the overtravel braking device, without the hoisting means covering a substantial distance during the free fall.

This object is achieved by the features of the independent patent claim 1, wherein advantageous embodiments are described by the features of the dependent claims.

An apparatus is provided for catching a shaft hoisting means in the case of the overtravelling of a hoisting device, including an overtravel braking device, wherein, according to the invention, coupling devices for automatic, form-fitting mutual engagement are provided for fixation to the braking device and the shaft hoisting means.

The disadvantages of the hitherto existing catching apparatus are largely minimized thereby, since the coupling devices contain a catching function and thus replace the hitherto existing catching apparatus in the form of pawls.

The coupling devices therein are preferably configured such that they lock the hoisting means with the brake frame immediately after the hoisting means hits the brake frame of the braking device, thereby reducing the height of the free fall to a minimum, wherein, through the coupling with the brake frame, the weight of the hoisting means, including the weight of the lower rope (when present) and the energy generated by the free fall in the case of rope breakage or absence of the braking effect of the hoisting machine control, is no longer absorbed in a catch-pawl platform, but in brake bands of the braking device.

Therefore the cost expenditure for the hitherto used static catch pawls can be omitted completely.

The coupling devices preferably consist of coupling claws on the one hand and holding elements compatible therewith on the other hand, with which the coupling claws can engage.

The coupling claws are preferably configured as self-opening, pivotally mounted lever elements supplied with a claw projection on the opposite end, wherein the coupling claws can be biased in the coupling position, preferably by corresponding spring elements.

Further preferably, the coupling claws therein are disposed on the brake frame of the braking device and the holding elements are disposed on the hoisting means. Shortly before the running onto the braking device, the lever elements pivot about a pivot joint, preferably by action of force by the moving hoisting means, and open thereby. Immediately after the holding elements of the hoisting means have passed the coupling claws, these close, for example by the action of the own weight of the coupling claws and/or by the supportive effect of force-storing elements, such as for example springs. The play between the coupling claws and the holding elements is preferably chosen so large that a minimum distance is present between the supporting surface of the coupling claws and the supporting surface of the holding elements.

At least the coupling claws and/or the holding elements can further by supplied with shock-absorbing elements, in order to cushion a hard coupling and/or catching of the hoisting means, thus keeping damage to persons and material as small as possible.

In order to prevent the coupling devices from sliding off each other in uncontrolled fashion, the mutual contact areas of the coupling devices can be supplied with a locking geometry or a corresponding undercut.

Alternatively to the above-described arrangement, the attachment of the coupling claws and of the holding elements can also be the other way around, wherein the holding elements are attached to the brake frame of the braking device, whereas the coupling claws are attached to the hoisting means. In the case of the opposite arrangement, the own weight of the coupling claws can be used only in limited fashion for the closing of the coupling elements, such that in this case an additional force is required for closing the coupling claws, and can be made available for example by a spring, as already described above.

According to the present invention, the hoisting means is consequently held immediately after hitting the brake frame of the braking device, so that scenarios in which the rope breaks will not lead to a crash of the hoisting means. The function of the overtravel braking device is not impeded by the suggested solution.

In contrast to known solutions, the suggested solution makes it possible to hold the overtravelling hoisting means in any position of the overtravel path.

BRIEF DESCRIPTION OF THE DRAWINGS

Further properties, features and advantages of the invention result from the following, purely illustrative and in no way limiting description of a preferred embodiment of the present invention with reference to the attached drawings, which are described as follows.

DETAILED DESCRIPTION OF THE PREFERRED EMBODIMENTS

Figure 1A:
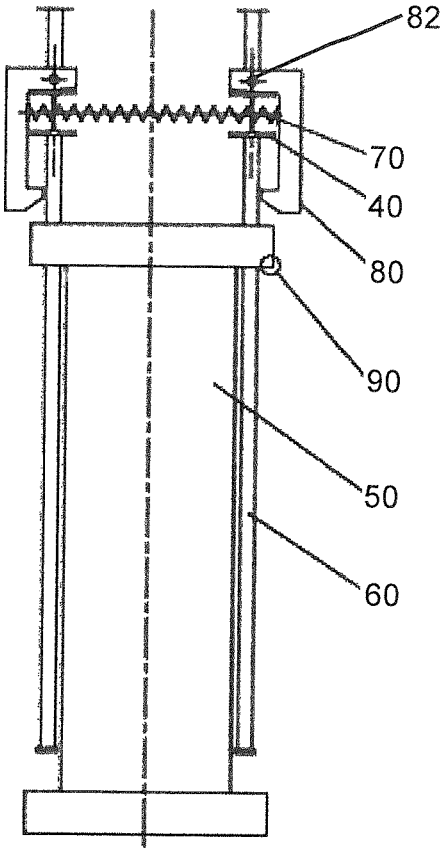
FIGS. 1*a*-1*d* a preferred embodiment of the apparatus for catching a shaft hoisting means.

The FIGS. 1*a*-1*d* show a preferred embodiment of the apparatus for catching a shaft hoisting means (50), wherein the respective FIGS. 1*a*, 1*b*, 1*c* and 1*d* show different stages of the hoisting means (50) moving into the apparatus for catching a shaft hoisting means (50).

In the FIGS. 1*a* to 1*d* the brake frame (40) of an SSA braking device can be recognized, which comprises also brake bands (60) among other things, by the plastic deformation of which (through roller boxes) the deceleration of the colliding hoisting means (50) takes place in the case of braking. Further, there can be recognized coupling claws (80) attached to the brake frame (40) and holding element (90) on the hoisting means (50), which can interact with the coupling claws (80).

The coupling claws (80), which are configured as L-shaped levers here and the pivot point (82) of which is arranged in the horizontal bar of the lever, are to lock the hoisting means (50) with the SSA brake frame (40) immediately after the hoisting means (50) hits the SSA brake frame (40), thereby reducing the height of the free fall to a minimum. The weight of the hoisting means (50) including the weight of the lower rope (when present) and the energy generated by the free fall in the case of rope breakage or absence of the braking effect of the braking system of the hoisting machine (not shown) is absorbed in the brake bands (60) of the braking device by coupling with the SSA brake frame (40).

Figure 1B:
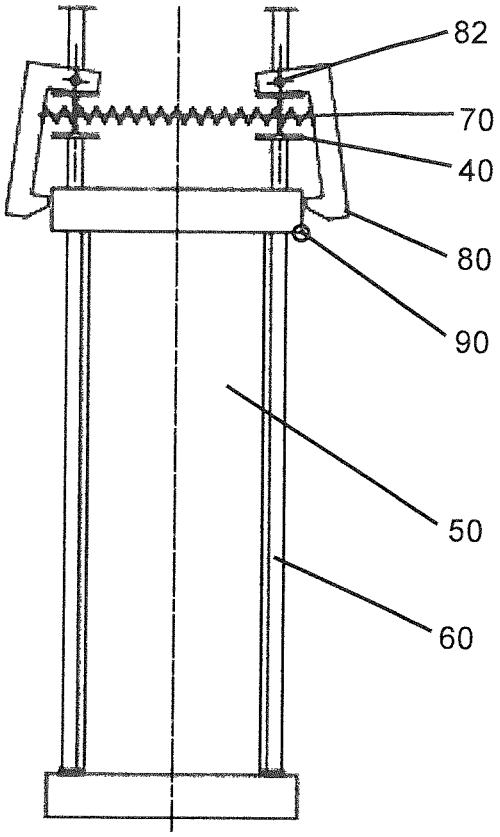
Figure 1C:
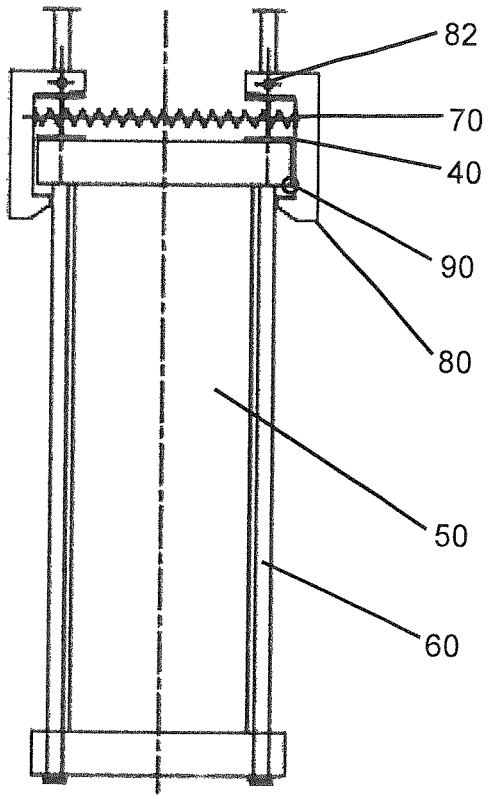

The coupling claws (80), as shown in FIG. 1*b*, are deflected when the hoisting means (50) hits the apparatus and pivot about their pivot point (82) shortly before the running onto the brake frame (40), in the represented example by action of force by the moving hoisting means (50), and open thereby Immediately after the holding elements (90) of the hoisting means (50) have passed the coupling claws (80), the coupling claws (80) close again, either by the action of the own weight of the coupling claws (80) or, as shown in the present example, by the action of springs (70). As shown in FIG. 1*c*, a play between the coupling claws (80) and the holding element (90) is chosen so large that a minimum distance is present between the supporting surface of the coupling claws (80) and the supporting surface of the holding elements (90).

Figure 1D:
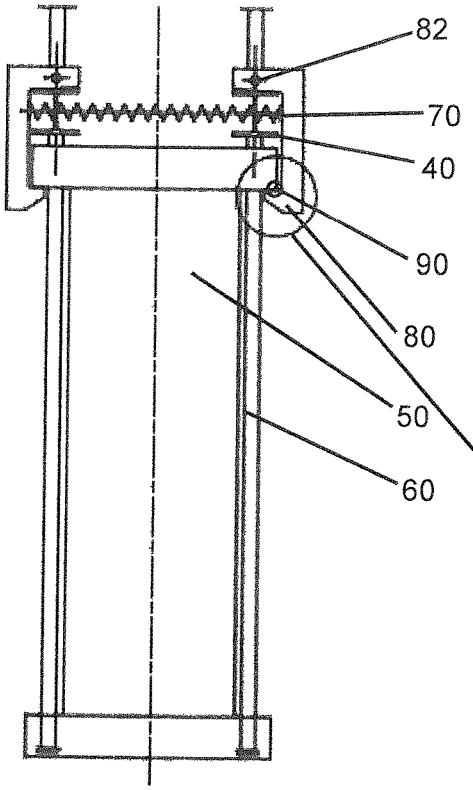

As can finally be gathered from FIG. 1*d*, the hoisting means (50) is brought to a standstill by the brake frame (40) in connection with the brake bands (60) and drops into the coupling claws (80), which hold the hoisting means (50), preventing a crash.

Figure 2:
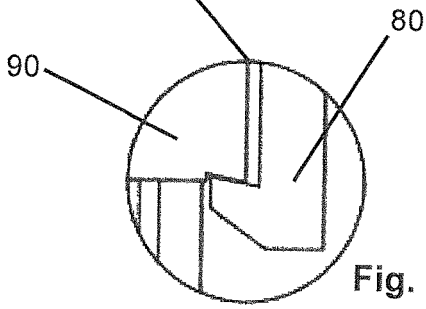
FIG. 2 a detail view of the apparatus for catching a shaft hoisting means according to FIG. 1*a*-1*d.

FIG. 2 shows a detail view of FIG. 1*d* in the area of the contact areas of the coupling claws (80) and the holding elements (90), with which the coupling claw (80) engages. As can be recognized, the contact areas in this special embodiment of this detail are beveled or undercut, in order to prevent the coupling claw (80) from sliding off the holding element (90).

Figure 3:
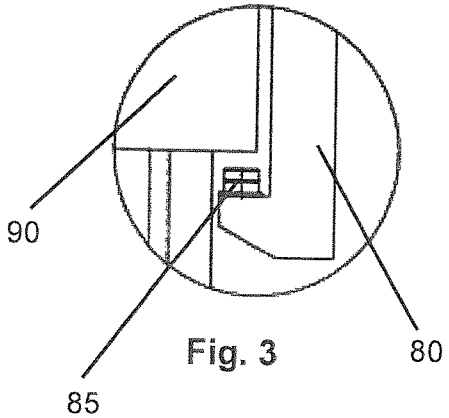
* and FIG. 3 a further detail view of the apparatus for catching a shaft hoisting means.

FIG. 3 shows a detail view of FIG. 1*c*, likewise in the area of the contact areas of the coupling claws (80) and the holding elements (90). As can be gathered from FIG. 3 in this regard, a dampening buffer (85) is provided on the contact area of the coupling claw (80), as a measure against a hard impingement of the hoisting means (50) on the coupling claws (80).

The invention claimed is:

1. An apparatus for catching a shaft hoisting conveyance in the case of overtravel of the hoisting conveyance, comprising:

an overtravel braking device comprising a brake frame;

coupling devices configured to provide mutual automatic, form-fitting engagement of the brake frame and a shaft hoisting conveyance, wherein said coupling devices comprise L-shaped levers each having a horizontal bar and a vertical bar and a pivot arranged in said horizontal bar; and brake bands coupled to the brake frame, wherein the brake bands are configured to provide plastic deformation through roller boxes for deceleration of the hoisting conveyance in the event of braking.

2. The apparatus according to claim 1, wherein the coupling devices further comprise:

coupling claws on said vertical bars; and holding elements compatible with said coupling claws, wherein said holding elements engage with the coupling claws.

3. The apparatus according to claim 2, wherein the coupling devices are configured as self-opening, pivotally mounted lever elements supplied with a claw projection on an end of said vertical bar opposite said horizontal bar.

4. The apparatus according to claim 3, wherein the coupling claws are biased in a coupling position.

5. The apparatus according to claim 4, wherein spring elements are provided for biasing the coupling claws.

6. The apparatus according to claim 2, wherein at least one of the coupling claws or the holding elements are supplied with shock-absorbing elements.

7. The apparatus according to claim 2, wherein play between the coupling claws and the holding element provides a minimum distance between a supporting surface of the coupling claws and a supporting surface of the holding elements.

8. The apparatus according to claim 1, wherein the mutual contact areas of the coupling devices are supplied with a locking geometry.

9. The overtravel braking apparatus according to claim 1, wherein the coupling devices further comprise:

coupling claws on said vertical bars; and holding elements on said shaft hoisting conveyance, said holding elements being compatible with said coupling claws, wherein said holding elements engage with the coupling claws.

10. The overtravel braking apparatus according to claim 9, wherein the coupling devices further comprise a dampening buffer on a contact area of the coupling claws for dampening impingement of the shaft hoisting conveyance on the coupling claws.

* * * * *